United States Patent [19]

Votta

[11] 4,052,577

[45] Oct. 4, 1977

[54] MAGNETICALLY DRIVEN RING-ARC RUNNER FOR CIRCUIT INTERRUPTER

[75] Inventor: Gerald A. Votta, King of Prussia, Pa.

[73] Assignee: I-T-E Imperial Corporation, Spring House, Pa.

[21] Appl. No.: 609,231

[22] Filed: Sept. 2, 1975

[51] Int. Cl.[2] ..... H01H 33/18

[52] U.S. Cl. ..... 200/147 R; 200/148 A; 200/148 B; 200/144 B

[58] Field of Search ..... 200/147 R, 144 B, 148 R, 200/148 A

[56] References Cited

U.S. PATENT DOCUMENTS

| | | | |
|---|---|---|---|
| 1,827,940 | 10/1931 | Greenwood | 200/147 R |
| 2,140,378 | 12/1938 | Biermanns et al. | 200/147 R |
| 3,210,505 | 10/1965 | Porter | 200/147 R |
| 3,551,625 | 12/1970 | Fischer | 200/147 R |
| 3,555,223 | 1/1971 | Robinson et al. | 200/144 B |
| 3,786,215 | 1/1974 | Mauthe | 200/148 A |
| 3,858,015 | 12/1974 | Deno | 200/148 R |
| 3,891,896 | 6/1975 | Clason | 200/147 R |
| 3,914,568 | 10/1975 | Crouch et al. | 200/144 B |

*Primary Examiner*—Robert S. Macon
*Attorney, Agent, or Firm*—Ostrolenk, Faber, Gerb & Soffen

[57] ABSTRACT

A single pressure sulfur hexafluoride circuit interrupter is contained in a bottle or elongated, cylindrical housing filled with gas under moderate pressure. The bottle contains arcing and main contacts arranged generally along the axis of the bottle and arranged to separate from one another in the vicinity of a pair of spaced, conductive rings fixed relative to one another, and which serve as arc runners. Each of the rings is connected in series with a respective coil which is wound on the axis of its respective ring and which encircles the cooperating contact and conductors therefor. The coils and the conductive rings create a magnetic field which spins an arc drawn between the spaced short-circuited rings through the sulfur hexafluoride gas, thereby to extinguish the arc. Each short-circuited ring and its respective coil are fixed relative to one another and are contained within a common insulation body in order to withstand the high electrodynamic forces created between the rings and coils during high current interruption. A small, low capacity puffer cylinder is connected to one of the moving contacts in order to produce at least a limited amount of gas motion through the arc space between the open contacts and the fixed rings when the contacts separate. The arcing contacts are arranged to have a blow-off path directed to cause an arc drawn between the contacts to transfer to the spaced conductive rings. In one embodiment of the invention, only a single coil is used to produce a magnetic field for spinning the arc between the spaced rings. The interrupter structure is useful in connection with a vacuum dielectric medium.

15 Claims, 13 Drawing Figures

FIG. 1.
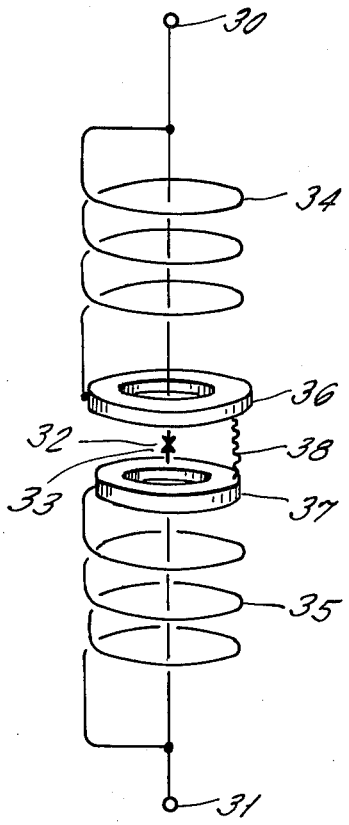
FIG. 2.
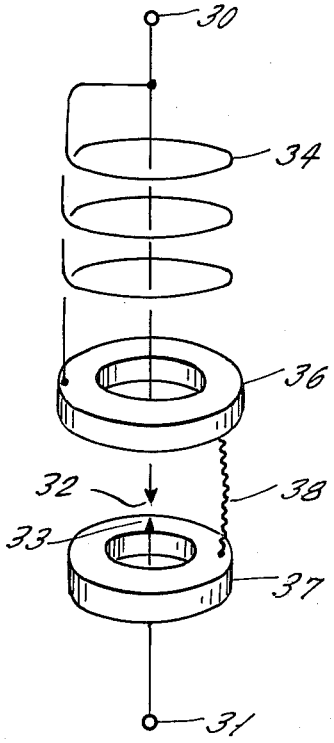
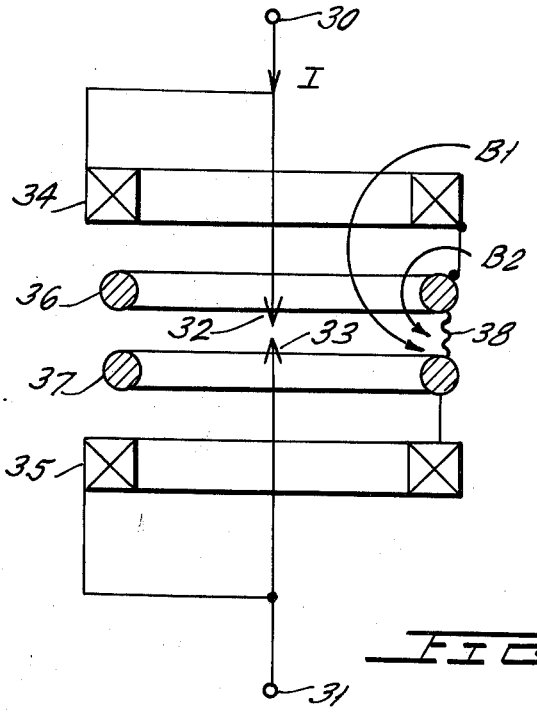
FIG. 1a.
FIG. 1b.
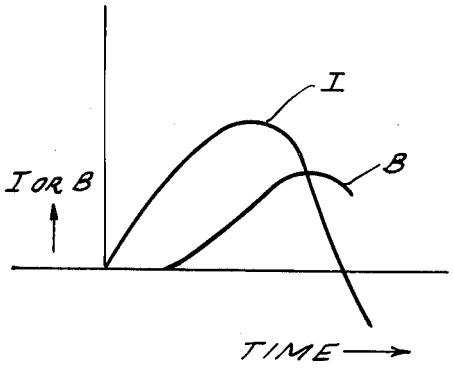

OPERATING MECHANISM
96
96a
31
41
95
42
70
71
72
73
80
85
7
78
76
74
75
81
84
93
90
100
77
94
89
91
6
50
51
52
48
61
82
62
5
49
47
60
44
45
46
30
40

MAGNETICALLY DRIVEN RING ARC RUNNER FOR CIRCUIT INTERRUPTER

RELATED APPLICATIONS

This application is related to copending application Ser. No. 609,161, filed Aug. 29, 1975, in the name of D. E. Weston, entitled HYBRID POWER CIRCUIT BREAKER; copending application Ser. No. 609,160, filed Aug. 29, 1975, in the name of D. E. Weston, entitled $SF_6$ PUFFER FOR ARC SPINNER; and copending application Ser. No. 609,559, filed Sep. 2, 1975 in the name of R. K. Smith, entitled CONTACT STRUCTURE FOR $SF_6$ ARC SPINNER, all of which are assigned to the assignee of the present invention.

BACKGROUND OF THE INVENTION

This invention relates to circuit interrupters, and more specifically relates to a novel, single-pressure bottle type interrupter which is filled with a relatively static dielectric gas or medium wherein arc interruption is obtained by rotating the arc through the relatively static gas.

The novel interrupter of the present invention has application over a wide range of voltage and current ratings and is particularly applicable to relatively high voltage ratings, such as 15 kV and above. At the present time, a variety of different types of interrupters and circuit breakers are used for interruption of high voltage circuits, but each of these are relatively expensive and have numerous operational disadvantages. For example, vacuum interrupters and air magnetic interrupters are frequently used in connection with 15 kV and 38 kV metalclad switchgear circuits. The air magnetic interrupter is old and well known and is large and expensive and requires frequent maintenance. In the air magnetic interrupter, a pair of contacts separate and the arc drawn between the contacts is transferred to respective arc runners which guide the arc into an arc chute, where the arc can be cooled and deionized and extinguished. Some air magnetic circuit interrupters are also provided with a small puffer arrangement, whereby an air stream flows through the arc to assist its movement into the arc chute. The concept of transferring an arc from a pair of separating contacts and guiding the motion of the arc by means of arc runners will be seen hereinafter to be employed conceptually in the present invention. In addition, the concept of a limited puffer will also be seen hereinafter to be employed with the present invention.

Vacuum interrupters are also well known, but these are expensive and are subject to breakdown following an interruption action. Vacuum interrupters moreover cause "chopping" during interruption on some circuits and can produce high voltage on those circuits. Vacuum interrupters frequently employ an arrangement which causes the arc drawn between the separating contacts to spin around the contacts, thereby to more evenly distribute the heat created by the arc on any localized area of the contact. As will be seen hereinafter, the present invention employs the general concept of arc spinning, although this is done in a totally different context in the present invention.

Bulk oil breakers are well known for applications, for example, in 15 kV ranges and above, but bulk oil breakers again are large and are expensive. The bulk oil breaker employs the concept of drawing an arc between separating contacts in a relatively high dielectric medium and also employs the concept of generating high-pressure gases which blast through the relatively stationary arc. As will be seen hereinafter, the concept of a relatively high dielectric medium is employed with the present invention but in a different context than used in the bulk oil breaker.

At higher voltages, for example, 121 kV and above, various interrupting mediums have been used to interrupt an arc including oil and air blast. Such breakers are large and expensive and create periodic maintenance. Two-pressure sulfur hexafluoride breakers are also used at these higher voltages, but the two-pressure breaker is again large and complex and requires equipment for maintaining relatively high gas pressures. The concept of the air blast breaker, like the oil breaker, relies on the high speed movement of a dielectric fluid through a relatively stationary arc in order to cool and extinguish the arc. A similar concept is employed in the two-pressure $SF_6$ interrupter wherein a relatively high speed movement of $SF_6$ through a relatively stationary arc permits the extinguishing of the arc. The present invention employs the general concept of relative movement of an arc with respect to a dielectric fluid.

Puffer type circuit breakers are also used in relatively high voltage ranges where the movement of the contacts causes a rapid flow of gas which moves through a relatively stationary arc in order to extinguish the arc. Breakers of this type are large and require considerable operating power in order to move the pressure-generating equipment and become complex and expensive and require periodic maintenance. The puffer breaker, like the two-pressure $SF_6$ breaker, relies on a high speed blast of dielectric fluid, such as sulfur hexafluoride gas, through a relatively stationary arc in order to extinguish the arc.

The novel circuit interrupter of the present invention can be used in place of the above type circuit interrupters of the prior art as well as others not mentioned above over a wide range of rated voltages and over a wide range of continuous current and interrupting current ratings.

In a specific application, the device of the present invention is a hermetically sealed bottle interrupter that can replace presently available vacuum bottle interrupters for 15.5 and 38 kV power circuit breakers. In another aspect of the invention, structures are provided which can be employed with a vacuum, as well as a gas dielectric medium.

The novel sealed bottle interrupter of the invention may also be used in combination with and in series with a vacuum interrupter, or with another gas-filled bottle, to form a high voltage, high capacity power circuit breaker, as disclosed in copending application Ser. No. 609,161, filed Aug. 29, 1975 to previously. When used in that manner, for a so-called hybrid circuit breaker, the dielectric recovery capability and dielectric withstand capability of the dielectric gas-filled bottle of this application cooperates synergistically with the interruption and thermal recovery characteristics of the vacuum or other interrupter.

BRIEF DESCRIPTION OF THE PRESENT INVENTION

The basic principle of the interrupters of the present invention is to employ the concept of rotation of a short controlled arc through a relatively static sulfur hexafluoride gas (or some other dielectric medium) in order to cool, deionize and extinguish the arc and thus open a circuit which is being protected.

The high speed continuous rotation of an arc in a gas medium as a means for interruption of current flow involves principles of interruption quite different from those of conventional $SF_6$, air or oil interrupters. Thus, each dielectric medium has some inherent capability for interrupting up to a particular magnitude of current with a particular recovery voltage when a stationary arc is drawn in a relatively static volume of that medium. In pure $SF_6$, that current might be about 100 amperes.

By causing the arc to rotate through the gas as in the present invention, the arc current magnitude will pass through an instantaneous current value of 100 amperes as the arc current approaches zero and, since the arc constantly rotates, it will always be moving in relatively clean gas generally equivalent to the situation that would exist if a stationary arc had been drawn in a static gas volume. The relative velocity of the arc relative to the gas is believed to be equal to or greater than the sonic velocity of gas through the nozzle of a conventional puffer breaker containing a stationary arc. Thus, all thermal history of the arc, both for the dielectric medium and the spaced ring-shaped electrodes, can be effectively distributed into the volume of the dielectric medium and the mass of the electrodes, which are made sufficiently large that no residual thermal effects remain during the time the current decreases from 100 amperes to zero.

By having a short arc length, by virtue of close spacing between the ring-shaped electrodes, there will be a relatively low thermal input to the dielectric medium during arcing. Moreover, close spacing of relatively massive, ring-shaped arcing electrodes provides a good thermal sink to conduct energy from the gap at the time of current zero.

A result of this novel, critical spacing between the ring-shaped electrodes is a rapid recovery of the dielectric strength of the medium after interruption at current zero, so that it can withstand transient recovery voltages.

Arc movement through the gas at relatively low current levels is ensured by providing a winding in series with at least one of the ring-shaped electrodes, so that the current being interrupted flows through the winding. The mutual coupling between the winding and the closed arcing ring induces current flow in the ring since it is a short-circuited winding. The resultant magnetic field of the current flow through the coil and the induced current in the ring creates a magnetic field through the gap between the spaced, conductive rings which is out of phase with the current being interrupted and which has a sufficient magnitude near current zero to ensure rotational movement of the arc current through the static gas or other interrupting medium, such as vacuum, filling the bottle.

The broad concept of moving an arc through a gas in order to assist in the interruption of the arc and the use of conductive rings associated with windings in series with the circuit to be interrupted for providing a magnetic field to rotate the arc is shown in the following publications: "Elektromagnitnoe gashenie dugi v elegaze" by A. I. Poltev, O. V. Petinov and G. D. Markush, from "Elektrichestvo," No. 3 (1967), pages 59–63; "Untersuchungen am rotierenden Schaltlichtbogen in Schwefelhexafluorid" by D. Markusch, from "Elektrie" No. 10 (1967), pages 364–67; and "Elegas circuit-breakers for 35–110 KV" by A. I. Poltev, from "Elektrotekhnike," No. 8 (1964).

The present invention provides numerous features which are not suggested in the above references but which allow the use of the concept of the publications in a practical circuit interrupter.

A first important aspect of the present invention involves the recognition of the need for relatively close spacing between the spaced stationary conductive rings which define an infinite arc runner. By way of example, the rings of the present invention, which may have an inner diameter of about 2 inches, an outer diameter of about 4 inches and a thickness of about one-fourth inch, are spaced from one another by about one-half inch or more, up to about 2 inches. By spacing the contacts this close and by making the rings relatively massive members, only a small amount of gas is instantaneously exposed to the arc and the total gas volume within the bottle is not greatly heated by the arc. The relatively massive conductive disks will act as extremely efficient heat sinks to conduct away localized heat created by the arc and its arc roots. Moreover, the arcing rings are made of copper as contrasted to a conventional arcing material such as copper-tungsten since relatively pure copper will allow easier motion of the arc root along its surface and thus will permit a higher velocity for the arc as its moves through the dielectric gas within the bottle. That is to say, conventional arc-resistant materials which one skilled in the art would normally select for a component subjected to an arc, such as copper-tungsten, produce a thermionic arc which is relatively difficult to move and requires relatively large amounts of energy for moving the arc along the material surface. Copper, on the other hand, which is used in accordance with the present invention, is a field-emitting material wherein the arc roots can be moved with small expenditure of energy.

The present invention also recognizes that extremely large electrodynamic forces are created between the winding which carries the current to be interrupted and which assists in the production of a magnetic field for rotating the arc and the closely coupled short-circuited ring. These electrodynamic forces have been so great that the apparatus tends to become self-destructive at fairly modest interrupting currents.

Therefore, in accordance with another important aspect of the invention, the two coils are mounted by potting in a common insulation housing, which may be an epoxy type material or a glass fibre reinforced plastic material, so that it can contain the tremendous repulsion forces created between the two windings during high current fault conditions.

A further important aspect of the present invention involves the incorporation of a small puffer arrangement for causing a relatively small gas movement through the space between the conductive arcing rings or arcing runners. As was pointed out previously, gas puffers are old and well known where, however, the puffer arrangement is used in combination with contacts that create a relatively stationary arc, whereby the motion of the gas through the arc affects its extinction.

The present invention employs the different concept of a relatively stationary gas and a movable arc for creating relative movement between the arc and the gas.

In accordance with another feature of the invention and even though the arc is moved relative to the gas, a small amount of gas movement is provided to assist in interruption of the arc in a current band where the current to be interrupted is insufficiently high to produce a strong enough magnetic field to move the arc at sufficient velocity to cause its effective interruption between the open contacts and the stationary arc runners, but is not low enough to be interrupted as a static arc in the static gas. In this situation, a modest movement of the gas relative to the arc (as compared to the massive movement of gas in a puffer type interrupter) will permit easy and effective interruption of the current in this small band so that the overall interrupter can now be used throughout a wide band of possible interruption current conditions.

Still another feature of the present invention is the novel provision of arcing and main contacts which extend along the axis of the bottle and which extend through and coaxially with the spaced arcing rings and the windings associated therewith. In addition to the use of the novelly arranged arcing contacts, contacts are further arranged to produce a magnetic blow-off path such that, as the arcing contacts open, the arc drawn between the arcing contacts is blown onto the fixed, spaced conductive rings which will receive the arc and have the arc rooted therearound in order to finally extinguish the arc.

The nature of the arc which is rotated between arcing rings of the present invention appears to be of the nature of a diffuse arc especially at relatively high current levels. A diffuse arc, in contrast to a coalesced arc, is a relatively low energy arc which will produce less heating and contact erosion than the coalesced arc which is the normal arc encountered in air and gas circuit interrupters. One of the advantages of the vacuum interrupter is that the vacuum arc is a diffuse arc so that little contact erosion is experienced in a vacuum interrupter. The appearance of a diffuse arc in a gas-type interrupter is wholly unexpected and leads to the extraordinary advantages of insignificant contact erosion, and increased interruption capability in a gas-type bottle interrupter.

BRIEF DESCRIPTION OF THE DRAWINGS

FIG. 1 is a schematic drawing of a circuit interrupter employing fixed, spaced conductive rings which serve as infinite arc runners with magnetic field-producing coils for each of the conductive rings.

FIG. 1*a* is a schematic cross-sectional view of the arrangement of FIG. 1 to illustrate the production of a magnetic flux between the fixed, spaced rings in order to cause the arc between the rings to rotate rapidly around the space between the rings.

FIG. 1*b* is a graph which illustrates the arc current and the magnetic field in the arrangement of FIGS. 1 and 1*a*, and illustrates the presence of a magnetic field for moving the arc at the critical time while the arc current is decreasing toward zero.

FIG. 2 shows an arrangement similar to that of FIG. 1 where, however, only a single magnetic field-producing coil is used for the two fixed, spaced conductive rings.

DETAILED DESCRIPTION OF THE DRAWINGS

Figure 3:
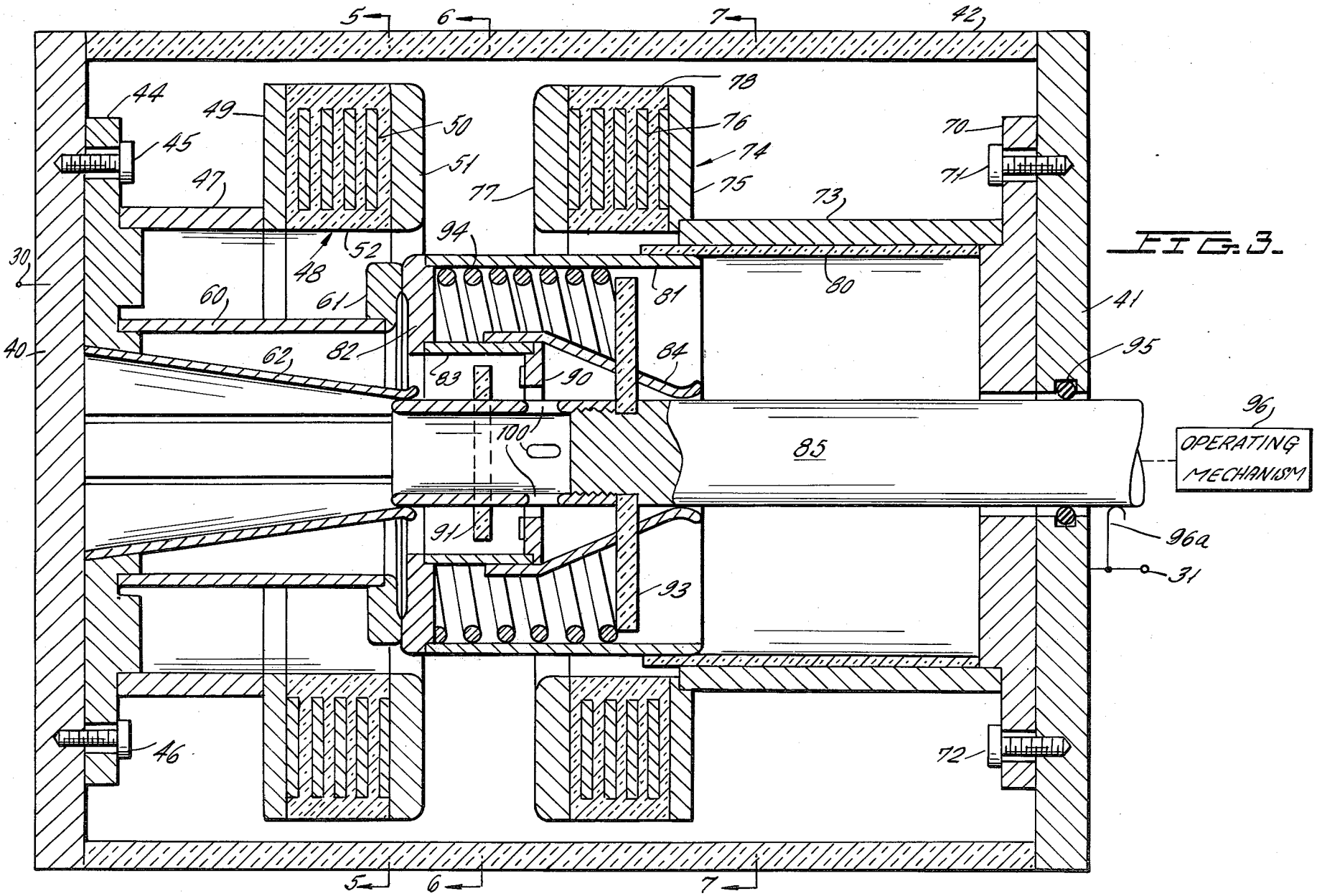
FIG. 3 is a cross-sectional view taken through the axis of a bottle interrupter constructed in accordance with the invention and shows the interrupter contacts and main contacts in their closed position.

Referring first to FIG. 1, there is schematically illustrated therein an arrangement for a circuit interrupter for opening the circuit between terminals 30 and 31. The circuit includes a pair of interrupter contacts schematically shown as interrupter contacts 32 and 33, respectively, which are connected to terminals 30 and 31, respectively. The conductors connecting terminals 30 and 31 to contacts 32 and 33, respectively, pass through multi-turn stationary windings 34 and 35, respectively, and fixed conductive copper rings 36 and 37, respectively. It will be noted that in the arrangement of FIG. 2 that the coil 35 has been removed in order to simplify the construction necessary for the interrupter by reducing the number of parts therefor. The coil 34 is then electrically connected to terminal 30 at one end and to the conductive ring 36 at its other end. Similarly, the coil 35 is connected to terminal 31 at one end and to ring 37 at its other end.

When the contacts 32 and 33 are closed, a circuit is formed directly between terminals 30 and 31. When, however, the contacts 32 and 33 open, an arc is drawn between them and this arc, as will be seen hereinafter in the more detailed embodiments of the invention, is transferred to the spaced stationary rings 36 and 37. An arc 38 is schematically illustrated between rings 36 and 37.

The entire assembly of FIG. 1 (and of FIG. 2) is contained within a bottle or suitable sealed housing filled with some suitable dielectric medium, such as sulfur hexafluoride gas at atmospheric pressure or at elevated pressure. This bottle is not shown in FIGS. 1 and 2, but will be described later in connection with FIGS. 3 to 7. Note that any desired dielectric gas could be used and, indeed, the interrupting medium could be air if the interrupter is to be used at relatively low voltages. Preferably, however, the dielectric medium will be sulfur hexafluoride or some other well-known electronegative gases or some mixture of an electronegative gas with some other dielectric gas, and also may be a vacuum.

The arrangements shown in FIGS. 1 and 2 will cause the arc 38 to rotate very rapidly around the rings 36 and 37. This rotation is caused by a radial magnetic field which is produced by the windings 34 and 35 and by the circulating current induced in rings 36 and 37. This is shown best in FIG. 1, for example, where a magnetic field $B_1$ associated with winding 34 passes through the gap between rings 36 and 37, whereby a force is produced on the arc current 38 which tends to cause it to rotate around the circular gap defined between rings 36 and 37. The magnetic field $B_1$ will also induce a circulating current in the rings 36 and 37 (which act as short-circuited turns) and this short-circuit current will give rise to a second magnetic field $B_2$ shown in FIG. 1*a*. The field $B_2$ will have a phase relationship with the field $B_1$ such that the fields oppose one another as the current I to be interrupted increases and will be additive as the current I decreases. Consequently, as shown in FIG. 1*b*, a resultant magnetic field B will be present in the vicinity of the arc 38 when the current I is decreasing toward current zero so that a substantial force is applied to the arc current 38 to cause it to move through the static dielectric gas in the gap between rings 36 and 37 as the current decreases toward zero. The arc current 38 is then extinguished as it passes through a current zero. Note that, in the absence of the phase shift which causes the field B to be relatively large toward the end of the current cycle, the driving force on the arc would decrease rapidly with the current so that the arc does not move rapidly enough to extinguish the arc as the arc current approaches zero current.

It has been previously thought necessary to use respective coils 34 and 35 with the spaced short-circuited rings 36 and 37.

FIG. 2, however, illustrates an arrangement whereby only a single coil 34 is used, where the coil 34 will produce the results shown in FIGS. 1*a* and 1*b* to ensure rapid rotation of the arc current 38 as the current approaches current zero. The elimination of the further coil associated with ring 37 produces substantial simplification and reduction in cost in the construction of an actual interrupter.

FIGS. 3 to 7 illustrate an embodiment of the invention in a circuit interrupter and illustrate the incorporation therein of a number of important features necessary to the successful operation of the interrupter.

Referring now to FIGS. 3 to 7, it will be understood that the illustration of the interrupter therein is shown in schematic form.

The housing or bottle for the interrupter consists of spaced conductive end plates 40 and 41 which are connected to terminals 30 and 31 (as in FIG. 1) and which receive and are supported at the opposite ends of an epoxy or ceramic cylinder 42. The ends of cylinder 42 may be secured to the end plates 40 and 41 in any desired sealed manner. The interior of the bottle is then filled with any desired dielectric medium, such as sulfur hexafluoride gas, at a pressure, for example, of 15 p.s.i.g. or greater. Generally, a higher pressure is desired at the higher voltage ratings.

End plate 40 then has a conductive disk 44 bolted thereto as by a bolt ring which includes bolts 45 and 46 and the conductive disk 44 then has a short copper tube 47 brazed or otherwise secured thereto to support a first composite ring 48. The composite ring 48 consists of a disk 49 which is welded or brazed to the right-hand end of cylinder 47, a helical winding 50 (which corresponds to winding 34 of FIG. 1) and the first fixed conductive ring 51 which corresponds to conductive ring 36 of FIG. 1.

Note that the disk 49 may contain axial slots therein (not shown) in order to prevent the formation of a short-circuited turn and the circulation of current induced from the winding 50. Similarly, conductive cylinder 47 may be slotted to prevent its appearance as a short-circuited turn.

The winding 50 is shown as a pancake type winding with one of its ends fixed to disk 49 and the other of its ends fixed to ring 51. Winding 50 can also be cylindrically oriented if desired.

The ring 51, winding 50 and disk 49 are made as a unitary ring structure and are fixed together by potting in an epoxy or glass fibre reinforced medium 42. This arrangement then gives extremely close magnetic coupling between winding 50 and ring 51 so that relatively high current can be induced in the ring 51, thereby to increase the magnetic field which is ultimately produced for rotating the arc which is to be extinguished by the apparatus as will be later described. The novel assembly of the composite ring 48 also provides a high-strength arrangement capable of withstanding the extremely large electrodynamic repulsion force produced between the winding 50 and the short-circuited ring 51 under high current conditions.

The conductive disk or support member 44 next receives a conductive tube 60 which is terminated by an arcing contact ring 61 which is brazed or otherwise secured to the end of tube 60. This constitutes a contacting arrangement equivalent to the arcing contact 32 of FIG. 1. If desired, contact ring 61 may have individually axially extending contact fingers extending from a ring-shaped hub.

In the embodiment of FIGS. 4 to 7, a further parallel contact arrangement is provided which serves as the main contact for the interrupter and consists of the segmented tubular contact 62 which is fastened at one end to the pad or conductive member 44 in any desired manner.

It will be noted that all of the components described above including the composite ring 48, the arcing contact 61 and the main contact 62 are all supported ultimately from end plate 40 and may be assembled with plate 40 before the interrupter bottle is closed.

The cooperating interrupter components are supported on the other end plate 41 and, more particularly, on a conductive plate 70 which is bolted to the end plate 41 by bolts 71 and 72 of a suitable bolt ring. A conductive tube 73 is then suitably secured to the plate 70 and supports a fixed composite ring 74 which is identical in construction to the composite ring 48 and which contains a support backplate 75, a winding 76 and a conductive ring 77. Note that winding 76 and ring 77 correspond to winding 35 and ring 37 of FIG. 1.

The composite ring 74 is held together by an epoxy body 78 similar to the epoxy body 52 of the composite ring 48. The two surfaces of rings 51 and 77 thus face one another and are fixed relative to one another.

Typically, the rings are of copper and may be spaced by ½ to 2 inches, with an inner diameter of 2 to 4 inches and an outer diameter of 4 to 6 inches, and an axial thickness of from ⅛ to 5/16 inches. Other dimensions can be used if desired to meet particular ratings.

In the manufacture of backplate 75 and tube 73, suitable slots may be used and might prevent the formation of a short-circuited turn which could drain energy from the winding 76 during the operation of the interrupter.

The interior of copper tubes 73 receives a tube 80 of insulation material, such as polytetrafluoroethylene (Teflon) which is suitably fixed inside of tube 73. The tube 80 then slidably receives a piston 81 formed by a conductive cylinder which has an arcing contact disk 82 across the outer left-hand end thereof. The arcing contact disk 82 cooperates with the arcing contact ring 61 and these arcing contacts may be of copper or of a conventional arcing material such as coppertungsten or the like. It may be preferable to use copper since it will enhance the transfer of the arc from the arcing contacts to the arcing rings.

The interior diameter of disk 82 then receives a conductive ring 83 as by brazing or the like and a plurality of spaced contact fingers 84 are fastened to and are electrically connected to the cylinder 83. These contact fingers 84 are in slidable electrical connection with the outer surface of the main moving contact 85 which will be later described.

The right-hand end of conductive tube 83 also has a disk 90 extending therefrom which cooperates with an extension 91 on the movable contact rod 85 in order to operate the gas puffer piston as will be later described. Contact rod 85 also has a spring support spider 93 extending therefrom which captures a compression spring 94 against the right-hand surface of interrupter contact disk 82.

Figure 4:
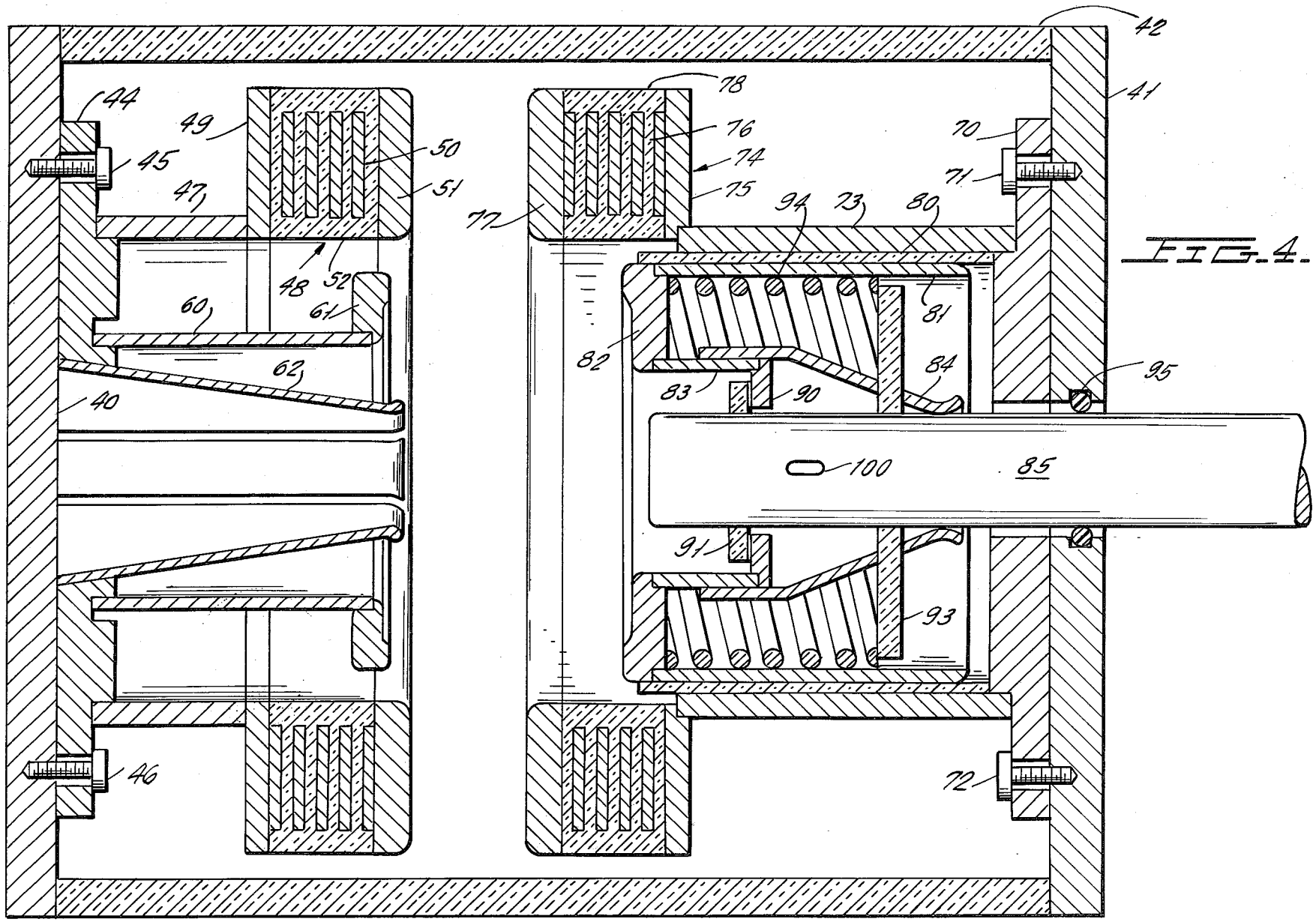
FIG. 4 is a cross-sectional view similar to that of FIG. 3, but shows the contacts in their open position.
Figure 5:
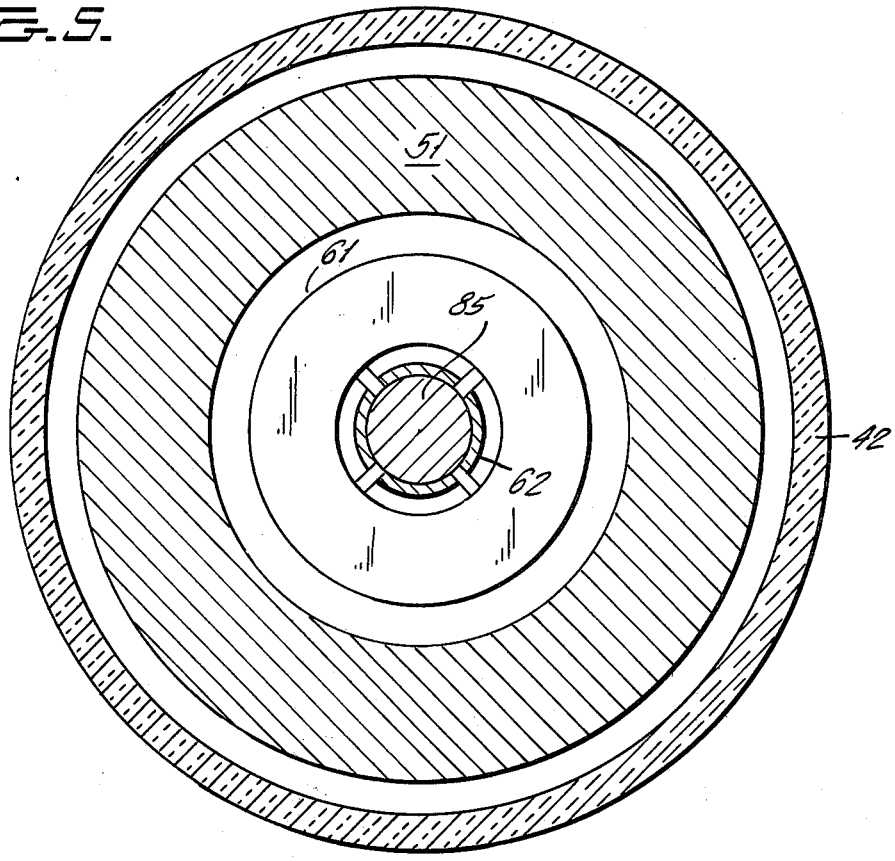
FIG. 5 is a cross-sectional view of FIG. 3 taken across the section lines 5—5 of FIG. 3.
Figure 6:
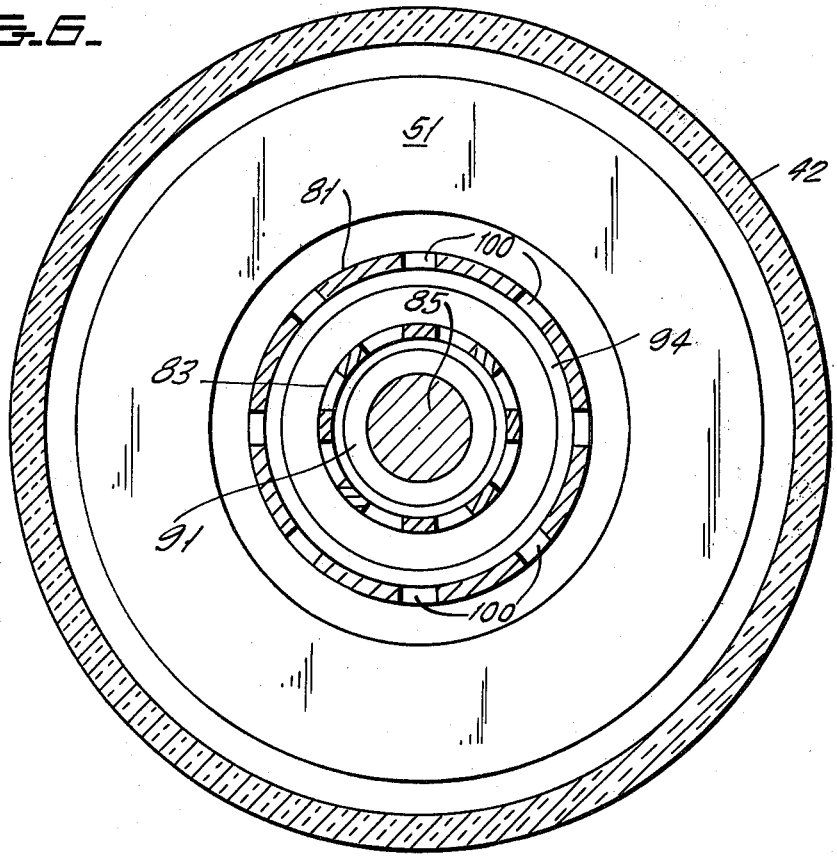
FIG. 6 is a cross-sectional view of FIG. 3 taken across the section lines 6—6 in FIG. 3.

The main moving contact rod 85 enters the interrupter bottle through the gas seal 95, or suitable bellows or the like, and is connected to a suitable operating mechanism 96 which moves the main moving contact in an axial direction and between its closed position of FIG. 3 and open position of FIG. 4.

The operation of the interrupter of FIGS. 3 to 7 is as follows:

When the interrupter is in its closed position, shown in FIG. 3, current flow proceeds from terminal 30, into plate 40, through main contact segment 62, into the main moving contact 85 to the terminal 31. Note that a sliding contact, schematically illustrated as sliding contact 96*a*, connects main contact 85 to the terminal 31 and to the plate 41.

When the main contacts are closed, most of the current flows through the main contacts and relatively little current flow takes place through the arcing contacts 61 and 82 because of their relatively high resistance contact compared to the low resistance of the main contacts.

In order to open the interrupter due either to a manual operation or an automatic operation initiated in response to a fault condition, the operating mechanism 96 causes the main moving contact 85 to move to the right and form the position of FIG. 3 toward the position of FIG. 4.

The end of the movable contact rod 85 will first separate from the main contact 62 and the current through the main contacts will commutate into the arcing contacts 61 and 82. Note that the arcing contacts 61 and 82 remain closed under the influence of spring 94 until the main movable contact has moved sufficiently far that the extension on the main contact rod 85 engages extension 90 on the tube 83. The current path for the current through arcing contacts 61 and 82 now includes tube 60, contact 61, contact 82, sliding contact fingers 84 and the contact rod 85.

Once extension 91 engages extension 90, the continued movement of main contact rod 85 to the right will cause arcing contact 82 to move to the right and will cause the initiation of an arc between arcing contacts 61 and 82. It will be noted that the current path taken by the current through the arcing contacts is a reentrant path having a general U shape in cross-section. As is well known, a path of this shape will apply a blow-off force to the current so that the arc current between arcing contacts 61 and 82 tends to move outwardly and away from the base of the U. Thus, the arc drawn between arcing contacts 61 and 82 will tend to expand radially outwardly away from the axis of the bottle and the arc roots will ultimately be transferred to conductive rings 51 and 77.

The current path through the interrupter then includes conductive tube 44, conductive ring 49, coil 50, ring 51, the current ring 77, coil 76, conductor 75, tube 73 and conductive plates 70 and 41 and thence terminal 31. The arc current between rings 51 and 77 is subjected to a magnetic field which will tend to cause the arc to rotate or spin around the axis of the bottle and through the relatively static gas within the bottle as was described in connection with FIGS. 1, 1*a* and 1*b*, whereby the arc is extinguished and the curcuit between terminals 30 and 31 is open.

It should be specifically noted that the cylinder 81 and arcing contact 82 define the movable piston of a puffer type arrangement which moves with respect to a cylinder 80. Thus, as the arcing contact 82 moves to the right in its motion to a disengaged position, it also compresses the gas within the interior of members 80 and 81.

Slots 100, located in contact 85, permit discharge of the gas toward the gap between arcing contacts 82 and 61. This then produces a relatively small gas blast action which permits the interruption of relatively low currents which might not otherwise be moving rapidly enough within the dielectric gas to be effectively interrupted. That is, a low current would create a relatively stationary or fixed arc on the arcing contacts 61 and 82.

It will be noted that the sequence of operation of the contacts of the interrupter is such that the main contacts are not subjected to any arcing duty so that its contacting surfaces remain clean and unpitted.

In reclosing the breaker, the opposite sequence from that described above will occur, whereby contact rod 85 is moved to the left. The interrupter contacts 61 and 82 will be the first to touch and thus will take the burden of in-rush current conditions. Thereafter, the main contacts 62 and 85 will engage under substantially arcless conditions and the interrupter is again in service.

Figure 9:
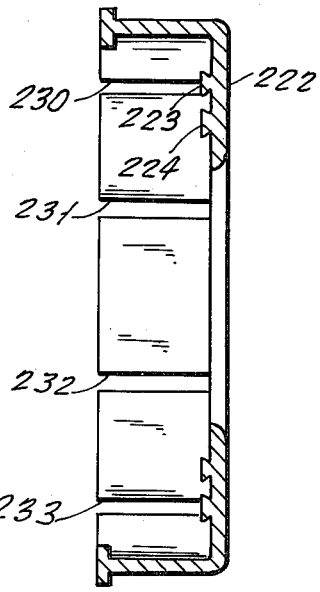
FIG. 9 is a cross-sectional view of one of the arcing rings of FIGS. 8.
Figure 8:
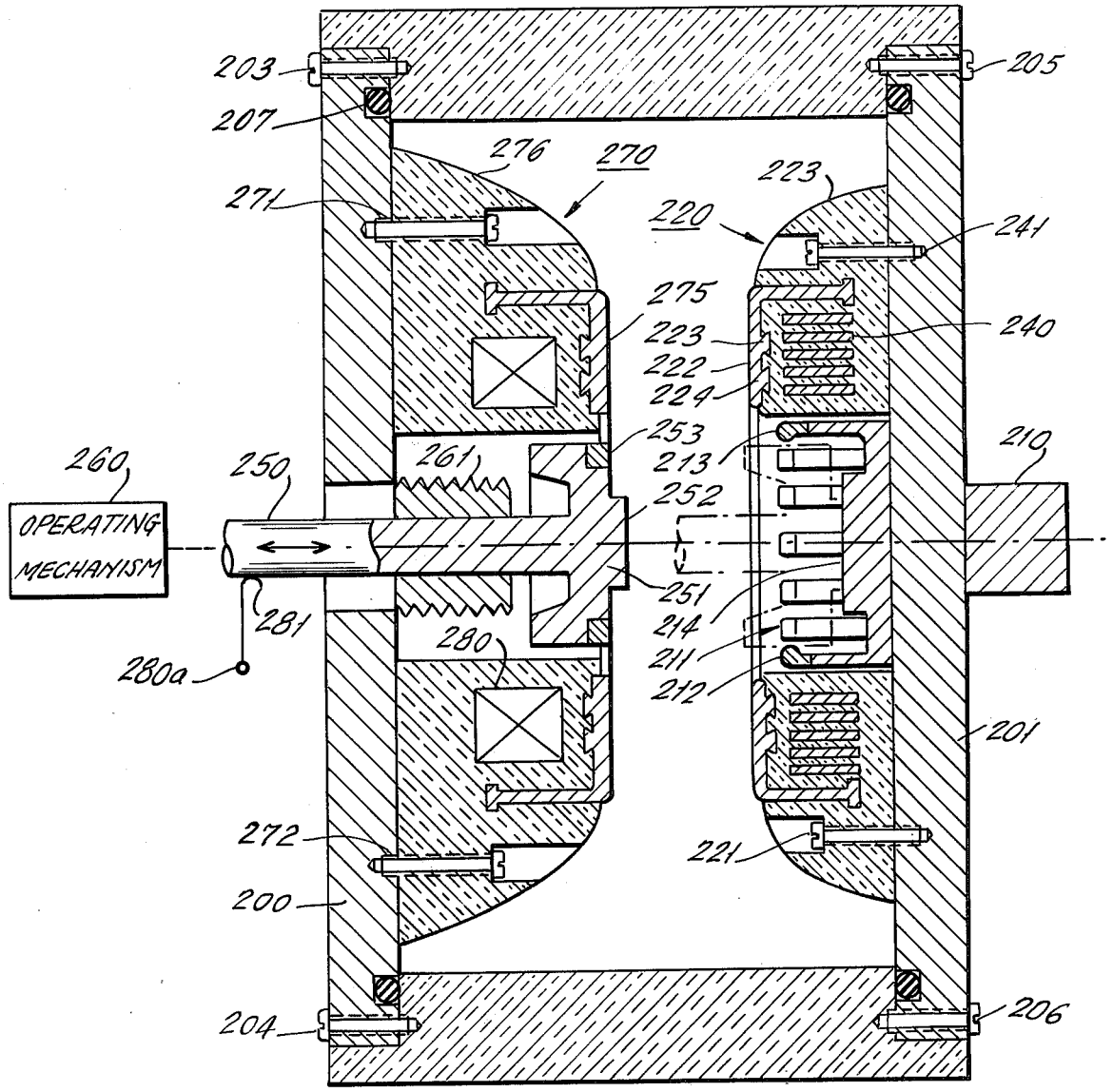
FIG. 8 is a longitudinal cross-sectional view of a further embodiment of the invention.

FIGS. 8 and 9 show a further embodiment of the invention, and demonstrate the simplicity which is permitted by the invention. In FIG. 8, the bottle-type housing is similar to that used in present vacuum bottles, except that the bottle is filled with dry sulfur hexafluoride gas at about 15 p.s.i.g or greater, and the bottle sealing problems are greatly simplified.

In FIG. 8 the bottle consists of conductive end plates 200 and 201 which are secured to the opposite ends of insulation cylinder 202 as by bolts 203 to 206. Sealing rings 207 and 208 seal plates 200 and 201, respectively, to cylinder 202.

Plate 201 has a terminal 210 connected thereto and receives a fixed cylindrical contact array 211 which consists of a plurality of individual contact fingers, such as fingers 212 and 213, which have arcing contact tips. The array 211 also includes a central raised pad 214 which serves as a fixed main contact.

The fixed contact array 211 is then surrounded by an arcing ring and winding assembly 220 which is suitably secured to plate 201, as by bolts such as bolt 221. The arcing ring 222 of assembly 220 is of copper and has a generally L-shaped cross-section to enhance its adhesion within epoxy housing 223. Note further that the rear of the flat surface of ring 220 has annular protrusions 223 and 224 to further assist in locking the ring 222 in epoxy housing 223. As shown in FIG. 9, the cylindrical extension of ring 222 is slotted, as at slots 230 to 233 to prevent current from circulating in this cylindrical section and to concentrate the flow of circulating current in the disk portion of ring 222.

A winding 240 is also potted within housing 220, where the winding may have from about 4 to about 30 turns. One end of winding 240 is connected to plate 201, as by bolt 241, and its other end is connected to arcing ring 222.

The movable contact of the interrupter of FIG. 8 includes the conductive shaft 250 having an enlarged circular contact head 251. Contact head 251 has an extending pad 252 which is engageable with pad 214, and an arcing ring 253, which is slidably received within the fingers of fixed contact array 211, as shown in dotted lines in FIG. 8. The movable contact shaft 250 is axially movable and is moved by operating mechanism 260. A bellows 261 connected between shaft 250 and plate 200 ensures a gas (or vacuum) seal therebetween. Sliding seals of known varieties could be used in place of bellows 261.

A second arcing ring assembly 270 then surrounds contact 251 as shown and is fixed to plate 200 as by bolts 271 and 272. The arcing ring assembly may be generally similar to arcing ring assembly 220, and contains an arcing ring 275, which may be identical to ring 222, in an epoxy housing 276. The assembly 270 may also contain a second winding, as shown schematically as winding 280, which is like winding 240 but is wound in a direction opposite to winding 240. However, winding 280 may be eliminated, with the magnetic flux for driving an arc around the rings 222 and 275 being derived from only winding 240 and the circulating current in rings 222 and 275.

When the interrupter of FIG. 8 is closed, a current path exists from terminal 280*a*, a suitable sliding contact 281, contact shaft 250, contact pad 252, fixed contact pad 214, and terminal 210.

When the interrupter is operated to an open position, contact shaft 250 moves to the left and the pads 214 and 252 separate and current flows from the arcing contact fingers 212 and 213 into the side of head 251 and ultimately into ring 253. As ring 253 parts from the contact fingers 212 and 213, an arc is drawn, and the arc tends to expand laterally because of the blow-off force created by the reentrant current path from shaft 250, head 251 and the contact fingers of contact array 211. This arc then transfers to arcing rings 222 and 275 and windings 240 and 280 (if used) are placed in series with terminals 210 and 280*a*. The magnetic field so produced then interacts with the arc plasma to cause effective arc interruption, whether by rapid rotation of a defined arc column, or by causing the arc to be a diffuse arc rather than a coalesced arc, as was previously described.

Figure 10:
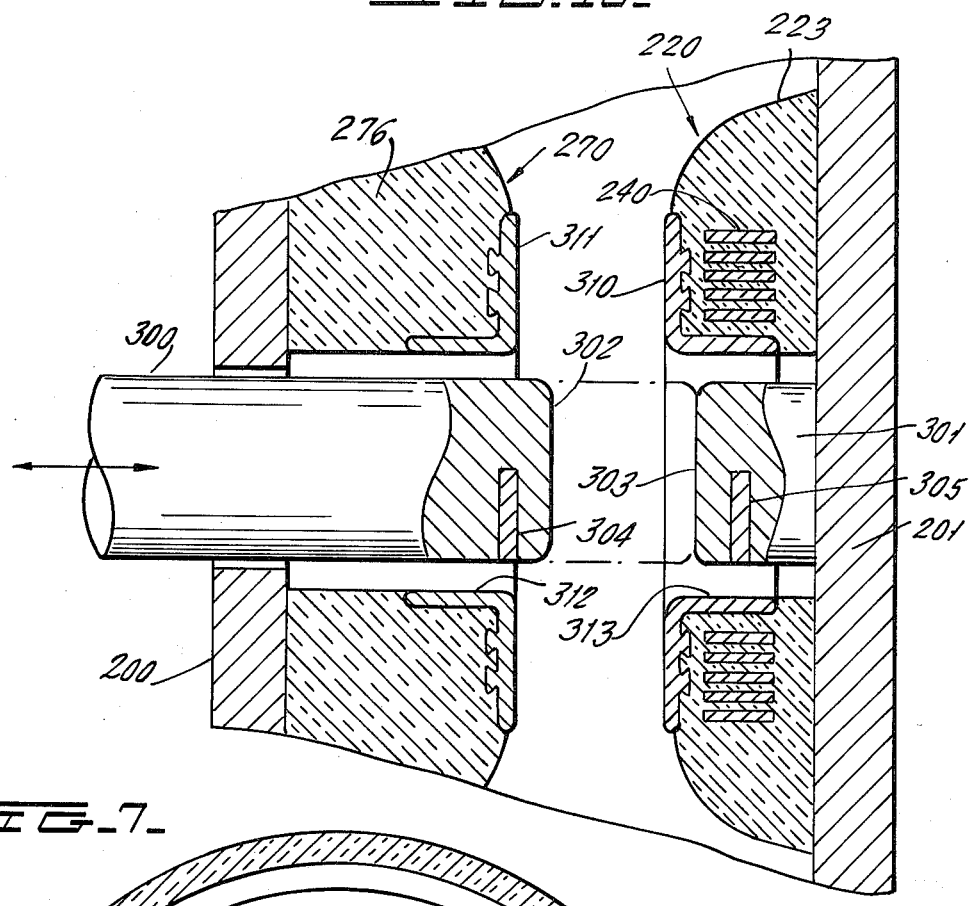
FIG. 10 is a partial cross-sectional view of a bottle interrupter like that of FIG. 8 where, however, the contacts and arcing contact rings are modified for use with a vacuum dielectric medium within the bottle.
Figure 7:
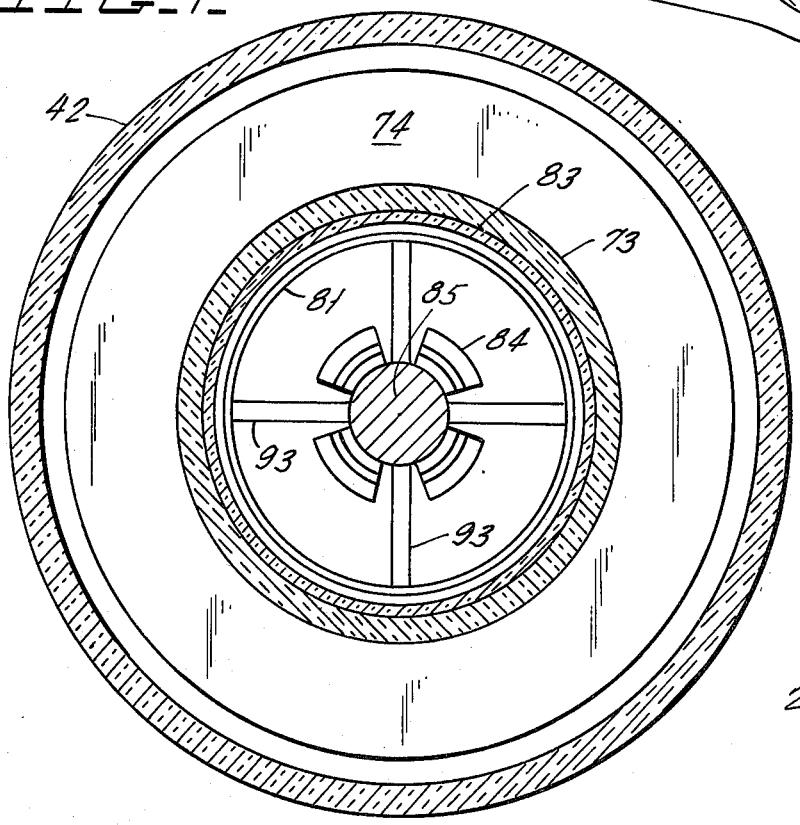
FIG. 7 is a cross-sectional view of FIG. 3 taken across the section lines 7—7 in FIG. 3.

FIG. 10 shows a modification of FIG. 8 to adapt it particularly to use with a vacuum dielectric medium. It is to be noted that sliding contacts should not be used in a vacuum environment since substantial operating force is needed to move the contacts relative to one another in the absence of a lubricating fluid. Thus, vacuum devices will generally use a butt contact arrangement as in FIG. 10, where the bottle interior is a vacuum medium rather than a dielectric gas.

In FIG. 10 the contacts are modified and include movable copper rod 300 and stationary copper rod 301 which engage one another at abutting surfaces 302 and 303. Stainless steel insert wafers 304 and 305 are placed in contacts 300 and 301, as shown to define a U-shaped path for current flow to create a blow-off force on the arc drawn when the contacts separate.

Spaced arcing rings 310 and 311 in insulating material housings 223 and 276, respectively, have been modified from those shown in FIG. 8, and the extending cylindrical body portions 312 and 313 now extend from the interior of the ring and face the contacts 300 and 301 to allow transfer of an arc from contacts 300 and 301 to rings 311 and 310, respectively.

Figure 11:
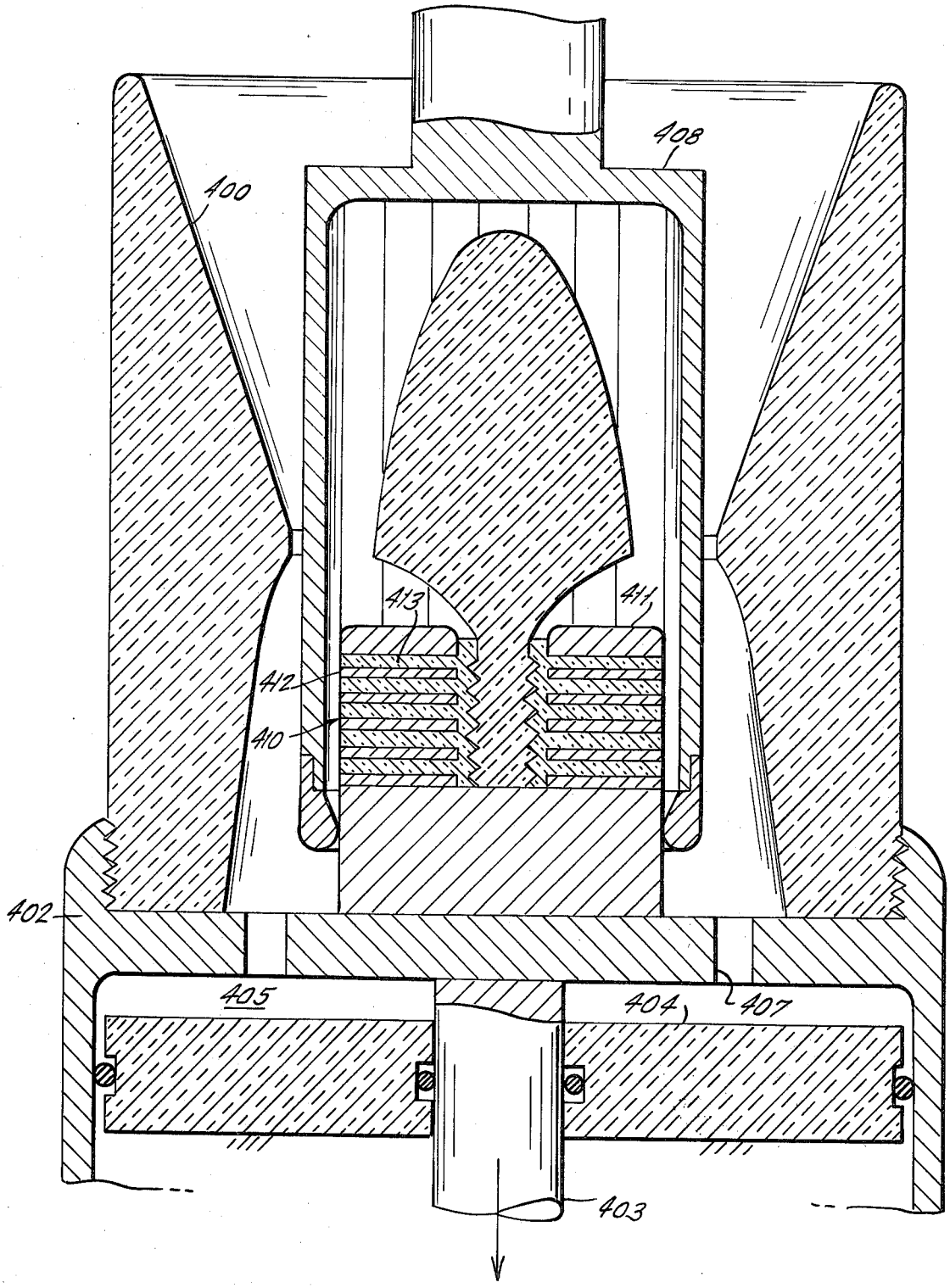
FIG. 11 illustrates the application of the invention to the buffer piston of a puffer-type circuit breaker.

FIG. 11 is a cross-sectional view of an insulation nozzle of a conventional puffer-type breaker of the type shown in copending application Ser. No. 506,426, filed Sept. 16, 1974 now Pat. No. 3,970,811, in the name of P. Krebs, entitled NOZZLE AND CONTACT ARRANGEMENT FOR PUFFER TYPE INTERRUPTER, the disclosure of which is incorporated herein by reference, and illustrates the application of the invention to such a device.

In FIG. 11, an insulation nozzle 400 is disposed within a dielectric gas environment, and is connected to move with a movable contact 401 by a circular conductive cylinder 402 which is carried on a movable contact shaft 403. Shaft 403 and cylinder 402 more over a stationary piston 404, whereby movement of cylinder 402 downwardly (in the drawing) compresses the volume 405 to produce a copious flow of gas through openings 406 and 407 into and through nozzle 400. The movable contact, at the same time, separates from stationary contact finger cluster 408, and the gas flow through the arc drawn was to extinguish the arc.

In accordance with the invention, an assembly 410 is fixed to movable contact 401 to incorporate the advantages of the invention in the conventional puffer arrangement. Assembly 410 includes a shorted arcing ring 411 which is connected to one end of a coaxial winding 412. The other and bottom end of winding 412 is connected to contact 401. An epoxy housing 413 then encapsulates the interior portions of winding 412, the bottom of ring 411 and an insulation plug 414.

The exterior of winding 412 makes sliding contact with stationary contact 408.Thus, when the contacts open, winding 412 is gradually inserted in series with contacts 401 and 408. When the contacts part by separation of disk 411 and contact 408, a strong circulating current flows in ring 411 and a radial magnetic field caused by the current in winding 412 and the circulating current in ring 411 causes the arc between ring 411 and contact 408 to rotate rapidly even prior to a current zero, thus contributing to the efficient interruption of the arc, along with the blast action caused by the reduction in volume 405.

Although the present invention has been described with respect to its preferred embodiments, it should be understood that many variations and modifications will now be obvious to those skilled in the art, and it is preferred, therefore, that the scope of the invention be limited not by the specific disclosure herein, but only by the appended claims.

The embodiments of the invention in which an exclusive privilege or property is claimed are defined as follows:

1. A circuit interrupter comprising first and second parallel coaxial rings of conductive material; said first and second rings having first respective confronting surfaces which are operable to define an arcing gap; at least said first ring comprising a high conductivity short-circuited turn; an electrical winding having a given number of turns disposed coaxially with said first and second rings and being positioned adjacent a surface of said first ring which is opposite to its said first surface; first and second electrical terminals for said circuit interrupter respectively connected to one end of said electrical winding and to said second ring; the other end of said electrical winding being connected to said first ring; first and second cooperable contacts connected to said first and second terminals, respectively, whereby, after said first and second contacts open, an arc is produced in said arcing gap between said first and second rings, and said arc between said first and second rings is rapidly rotated around said gap; and a sealed housing filled with a static dielectric gas under pressure greater than atmospheric pressure for housing said circuit interrupter; said gap between said first and second rings being at least large enough to withstand the maximum voltage to be applied across said gap after said arc is extinguished; said first and second rings being relatively massive, thereby to serve as good heat sinks to the localized heat generated by the arc therebetween; said electrical winding being closely magnetically coupled to said first ring whereby, when arc current flows in series with said winding, a high current is induced in said ring, thereby to produce a magnetic field which is phase-shifted from the arc current, thereby to cause rapid rotation of said arc in said gap, even at low instantaneous current; said first ring and said winding being rigidly immersed in a potted insulation ring, thereby to be rigidly supported against electrodynamic forces of repulsion between said closely spaced first ring and winding.

2. The circuit interrupter of claim 1 wherein said first ring is of copper.

3. The circuit interrupter of claim 1 wherein said dielectric medium consists of sulfur hexafluoride under pressure.

4. The circuit interrupter of claim 1 which further includes a second winding wound coaxially with said first winding and connected between said second ring and said second terminal.

5. The circuit interrupter of claim 4, wherein said second ring and said second winding are rigidly immersed in a second potted insulation ring.

6. The circuit interrupter of claim 5 wherein said first and second rings are of copper.

7. The circuit interrupter of claim 6 wherein said dielectric medium consists of sulfur hexafluoride under pressure.

8. The circuit interrupter of claim 3 wherein said first and second rings are of copper, and wherein the arc between said first and second rings is a diffuse arc.

9. The circuit interrupter of claim 1 wherein said first ring has an auxiliary axial extension thereon to assist in anchoring said first ring in said potted insulation ring.

10. The circuit interrupter of claim 9 wherein said axial extension is slotted to prevent the circulation of current therearound.

11. The circuit interrupter of claim 1 which further includes reentrantly shaped locking sections protruding from the surface of said first ring to assist in anchoring said first ring in said potted insulation ring.

12. The circuit interrupter of claim 1 wherein said first and second contacts engage in abutting contact relationship.

13. A circuit interrupter comprising first and second arcing electrodes having first respective spaced surfaces forming an arc in a relatively predetermined small arc gap; said first arcing electrode comprising a copper ring; an electrical winding having a given number of turns disposed coaxially with said first and second arcing electrodes and being positioned adjacent a surface of said ring which is opposite to its said first surface; first and second electrical terminals for said circuit interrupter respectively connected to one end of said electrical winding and to said second arcing electrode; the other end of said winding being connected to said rings; first and second cooperable contacts connected to said first and second terminals respectively, whereby after said first and second contacts open, an arc is produced between said first and second arcing electrodes, and said arc is rotated rapidly around said gap and said ring; and a sealed housing filled with a dielectric gas under pressure housing said circuit interrupter; said ring being relatively massive to serve as a good heat sink to the localized heat generated by the arc within said gap; said ring and winding being potted in a common rigid insulation housing, and being separated by a minimum distance, and being closely coupled to one another.

14. The circuit interrupter of claim 12 wherein an outer surface of said winding is in sliding contact with said first contact, whereby said winding is gradually inserted in series with said first and second contacts as said contacts move to disengaged position.

15. The circuit interrupter of claim 14 which further includes a movable nozzle fixed to and movable with said winding and said ring, and a relatively movable piston and cylinder for forcing gas flow into said gap and through said nozzle during operation of said first and second contacts to their said disengaged position.

* * * * *